US012723318B2

(12) United States Patent
Brodjonegoro et al.

(10) Patent No.: US 12,723,318 B2
(45) Date of Patent: Sep. 1, 2026

(54) METHOD FOR EXTRACTING METALS FROM SAPROLITE LATERITE NICKEL ORE

(71) Applicants: PT ESG NEW ENERGY MATERIAL, Jakarta (ID); PT QMB NEW ENERGY MATERIALS, Jakarta (ID); GEM CO., LTD., Shenzhen (CN); PT GEM INDONESIA NEW ENERGY MATERIALS, Jakarta (ID)

(72) Inventors: Satryo Soemantri Brodjonegoro, Jakarta (ID); Kaihua Xu, Shenzhen (CN); Rizky Wanaldi, Jakarta (ID); Tegar Mukti Aji, Jakarta (ID); Andi Syaputra Hasibuan, Jakarta (ID); Shella Arinda, Jakarta (ID); Evan Wahyu Kristiyanto, Jakarta (ID); Yi Wang, Jakarta (ID)

(73) Assignees: PT ESG NEW ENERGY MATERIAL, Jakarta (ID); QT QMB NEW ENERGY MATERIALS JAKARTA, Jakarta (ID); GEM CO., LTD., Shenzhen (CN); PT GEM INDONESIA NEW ENERGY MATERIALS, Jakarta (ID)

( * ) Notice: Subject to any disclaimer, the term of this patent is extended or adjusted under 35 U.S.C. 154(b) by 47 days.

(21) Appl. No.: 18/870,484

(22) PCT Filed: Jul. 27, 2023

(86) PCT No.: PCT/CN2023/109609

§ 371 (c)(1),
(2) Date: Nov. 29, 2024

(87) PCT Pub. No.: WO2025/020177

PCT Pub. Date: Jan. 30, 2025

(65) Prior Publication Data

US 2026/0110103 A1 Apr. 23, 2026

(51) Int. Cl.
*C25C 1/24* (2006.01)
*C22B 1/24* (2006.01)
(Continued)

(52) U.S. Cl.
CPC ..... *C25C 1/24* (2013.01); *C22B 1/24* (2013.01); *C22B 3/08* (2013.01); *C22B 3/22* (2013.01)

(58) Field of Classification Search
CPC .... C25C 1/00; C25C 1/06; C25C 1/08; C25C 1/10; C25C 1/12; C25C 1/16; C25C 1/22; C25C 1/24
See application file for complete search history.

(56) References Cited

FOREIGN PATENT DOCUMENTS

CN 104789766 A 7/2015
CN 105887136 A * 8/2016 ..... C25C 1/08
(Continued)

OTHER PUBLICATIONS

Xu et al. "Extracting of copper from simulated leaching solution of copper-cadmium residues by cyclone electrowinning technology" Hydrometallurgy 194 (2020) 105298 (Year: 2020).*
(Continued)

*Primary Examiner* — Luan V Van
*Assistant Examiner* — Alexander R. Parent
(74) *Attorney, Agent, or Firm* — Hempisphere Law, PLLC

(57) ABSTRACT

A method for extracting metals from saprolite laterite nickel ore includes: separating and grinding the saprolite laterite nickel ore to obtain a laterite nickel ore powder; mixing the laterite nickel ore powder, water, an acid, and a reducing agent to perform atmospheric pressure acid leaching to obtain a leaching residue and a leaching solution; adding a soluble fluoride salt and sodium salt to the leaching solution to obtain a silicon-aluminum residue and a de-silicon-aluminumed liquid; adding a phosphorus source to the de-silicon-aluminumed liquid, and performing solid-liquid separation to obtain an iron phosphate and a de-ironed liquid; subjecting the de-ironed liquid to a one-step cyclone electrolysis to obtain a zinc-chromium alloy and a one-step cyclone electrolyzed liquid; subjecting the one-step cyclone electrolyzed liquid to a two-step cyclone electrolysis to obtain a nickel-cobalt alloy, a manganese oxide, and a two-step cyclone electrolyzed liquid; and adding sodium carbonate to the two-step cyclone electrolyzed liquid for a
(Continued)

precipitation reaction to obtain magnesium carbonate and a de-magnesiumed liquid. The disclosure achieves the short-flow separation and extraction of different valuable metal elements such as zinc, chromium, nickel, cobalt, and manganese in the saprolite laterite nickel ore, which is an economic, efficient, green, and environment-friendly extraction process.

10 Claims, 1 Drawing Sheet

(51) Int. Cl.
*C22B 3/08* (2006.01)
*C22B 3/22* (2006.01)

(56) References Cited

FOREIGN PATENT DOCUMENTS

CN 109652646 A * 4/2019 ..... C25C 1/08
CN 115180653 A * 10/2022 ..... C01G 51/10

OTHER PUBLICATIONS

Li et al. "Near-Zero-Waste Approach for the Treatment of Saprolitic Nickel Laterite via a Combined Hydrometallurgical Process" ACS Sustainable Chem. Eng. 2023, 11, 6856-6865 (Year: 2023).*
Claims of PCT/CN2023/109609.
CNIPA (ISA), Written opinion for PCT/CN2023/109609, Dec. 15, 2023.

* cited by examiner

METHOD FOR EXTRACTING METALS FROM SAPROLITE LATERITE NICKEL ORE

FIELD OF THE DISCLOSURE

The disclosure relates to the technical field of laterite nickel ore hydrometallurgy, and more particularly to a method for extracting metals from saprolite laterite nickel ore.

BACKGROUND

With the rapid development of new energy, ternary lithium power is an important part of the future new energy field. Nickel, as one of the important elements of ternary lithium power, the efficient extraction technology of nickel resources becomes the key to the whole new energy industry. Laterite nickel ore is one of the main forms of nickel in nature, with huge reserves.

Current treatment processes for laterite nickel ore include pyrometallurgy and hydrometallurgy. The basic treatment processes for laterite nickel ore with a nickel grade of less than 1.3% are based on hydrometallurgy, including mineral pretreatment, high-pressure leaching, neutralization for impurity removal, precipitation of nickel-cobalt hydroxide, acid reverse dissolution, and extraction and crystallization to obtain a variety of nickel-cobalt products. Low-grade saprolite laterite nickel ore contains a large amount of iron, magnesium, and other elements. In the above-mentioned process flow, iron is directly discarded as slag, and magnesium is directly discharged as entrained elements in wastewater, resulting in a great waste of resources.

At present, the research on the process of low-grade laterite nickel ore is based on the use of nickel and cobalt in minerals as the basic starting point, but the other valuable metals are not used reasonably. It has also been reported to recover iron concentrate from laterite nickel ore smelting slag by means of reduction roasting-magnetic separation, but due to the low added value of iron, it often has no economic benefits. For example, Patent CN103526046A discloses an additive for the reduction of a humus-type laterite nickel ore and the use thereof, wherein the humus-type laterite nickel ore is added with an additive, reduced, crushed, and ground to obtain a powder, and then a nickel-iron alloy is obtained by magnetic separation. Therefore, it is necessary to develop a method for extracting various valuable metals from saprolite laterite nickel ore.

SUMMARY

In view of the deficiencies of the prior art, it is an objective of the disclosure to provide a method for extracting metals from saprolite laterite nickel ore. The disclosure combines the methods of wet treatment and electrochemical metallurgy to achieve the extraction and recovery of iron, magnesium, and other elements in the treatment stage of laterite nickel ore, achieve the short-flow deep separation of different metal elements, and improve the utilization rate of valuable metals in the laterite nickel ore.

To achieve the above objectives, the disclosure is implemented through the following technical solution:

A method for extracting metals from saprolite laterite nickel ore, including the following steps:

(1) separating and grinding the saprolite laterite nickel ore to obtain a laterite nickel ore powder;

(2) mixing the laterite nickel ore powder, water, an acid, and a reducing agent to obtain an ore pulp, and subjecting the ore pulp to atmospheric pressure acid leaching to obtain a leaching residue and a leaching solution;

(3) adding a soluble fluoride salt and soluble sodium salt to the leaching solution to obtain a silicon-aluminum residue and a de-silicon-aluminumed liquid; wherein the silicon-aluminum residue contains sodium fluoroaluminate and sodium fluorosilicate;

(4) adding a phosphorus source to the de-silicon-aluminumed liquid, and performing solid-liquid separation to obtain an iron phosphate and a de-ironed liquid;

(5) subjecting the de-ironed liquid to a first step of cyclone electrolysis to obtain a zinc-chromium alloy and a first cyclone electrolyzed liquid;

(6) subjecting the first cyclone electrolyzed liquid to a second step of cyclone electrolysis to obtain a nickel-cobalt alloy, a manganese oxide, and a second cyclone electrolyzed liquid; and (7) adding sodium carbonate to the second cyclone electrolyzed liquid for a precipitation reaction to obtain magnesium carbonate and a de-magnesiumed liquid.

Preferably, the acid in step (2) is an organic acid or an inorganic acid, and the reducing agent is one or more of sodium sulfite, sodium bisulfite, sodium metabisulfite, iron powder, and ferrous sulfate.

Preferably, in step (2) the concentration of the acid is 1-3 mol/L; the dosage of the reducing agent is 5-20 g/L; and the solid-liquid ratio of the ore pulp is 50-300 g/L.

Preferably, the leaching temperature of the atmospheric pressure acid leaching in step (2) is 50-90° C. and the leaching time is 1-5 h.

Preferably, the soluble fluoride salt in step (3) is at least one of sodium fluoride, potassium fluoride, and ammonium fluoride; the soluble sodium salt is at least one of sodium fluoride, sodium chloride, and sodium sulfate.

Preferably, in step (3), the dosage of the soluble fluoride salt used is 3-20 g/L and the dosage of the soluble sodium salt is 5-20 g/L; and the pH of the leaching solution is controlled to be 1-3 by using a dilute alkaline solution, and the reaction is carried out at room temperature for 0.5-3 h.

Preferably, the phosphorus source in step (4) is one or more of phosphoric acid, sodium phosphate, ammonium dihydrogen phosphate, ammonium monohydrogen phosphate, and ammonium phosphate; the molar ratio of the phosphorus source to the elemental iron in the leaching solution is (1-1.1): 1.

Preferably, in the first step of cyclone electrolysis of step (5), the acidity of the de-ironed liquid is 0.1-0.3 mol/L; the temperature is 30-40° C.; the current density is 400-600 $A/m^2$; and the electrolysis time is 5-10 h.

Preferably, in the second step of cyclone electrolysis of step (6), the pH of the first cyclone electrolyzed liquid is controlled to 2-4; the temperature is 40-50° C.; the current density to 100-200 $A/m^2$; and the electrolysis time is 5-10 h.

Preferably, the method described above further includes subjecting the de-magnesiumed liquid to evaporation and concentration to obtain sodium sulfate, and the sodium sulfate is reused as a sodium salt for silicon-aluminum removal in step (3).

ADVANTAGEOUS EFFECT OF THE DISCLOSURE

In view of the low recovery and utilization rate of resources in the saprolite laterite nickel ore, the disclosure proposes a method for extracting metals from saprolite laterite nickel ore. The method achieves the short-flow deep separation and extraction of different valuable metal elements such as zinc, chromium, nickel, cobalt and manganese in the saprolite laterite nickel ore through the steps of atmospheric pressure acid leaching—silicon-aluminum removal—iron phosphate precipitation—first step of cyclone electrolysis—second step of cyclone electrolysis—magnesium carbonate precipitation, which is an economic, efficient, green, and environment-friendly extraction process.

In the disclosure, the filtrate with magnesium being extracted is subjected to evaporation, concentration, and crystallization to separate sodium sulfate. The sodium sulfate is reused in the step of silicon-aluminum removal, thereby greatly reducing production costs and achieving a high degree of resource utilization.

BRIEF DESCRIPTION OF THE DRAWINGS

In order to more clearly illustrate the technical solutions of the embodiments of the disclosure, the accompanying drawings of the embodiments will be briefly described below.

DETAILED DESCRIPTION OF PREFERRED EMBODIMENTS

The technical solutions in the embodiments of the disclosure will be described clearly and completely in conjunction with the embodiments of the disclosure. Obviously, the described embodiments are only a part of the embodiments of the disclosure, rather than all the embodiments. Based on the embodiments of the disclosure, all other embodiments obtained by a person of ordinary skill in the art without inventive effort fall within the scope of the disclosure.

Figure 1:
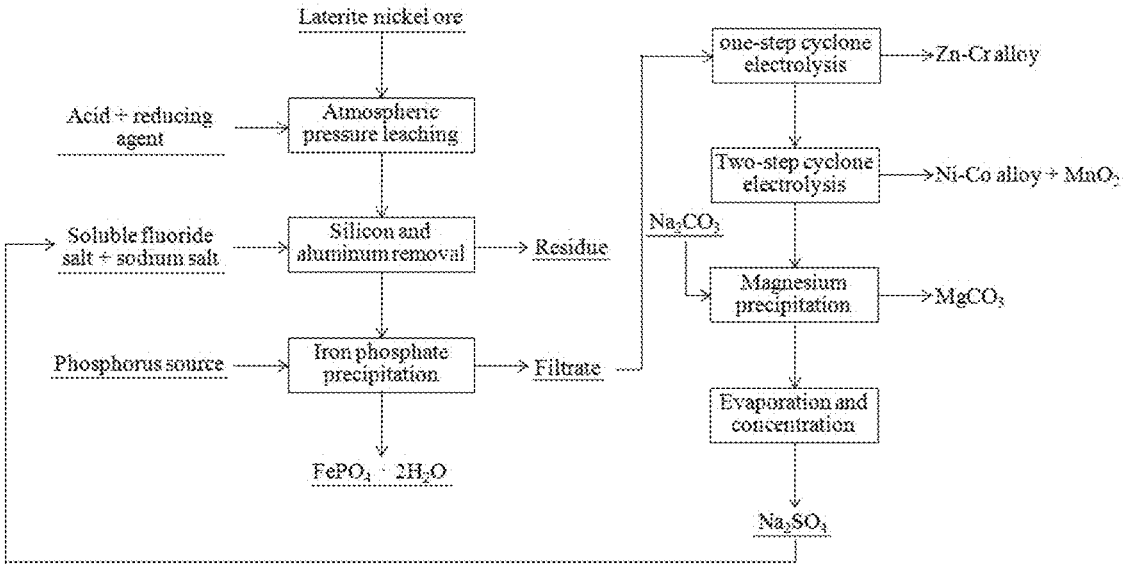
FIG. 1 is a flow diagram of a method for extracting metals from saprolite laterite nickel ore in accordance with the disclosure.

Referring to FIG. 1, the disclosure provides a method for extracting metals from saprolite laterite nickel ore, including the following steps:

(1) Separating and grinding the saprolite laterite nickel ore to obtain a laterite nickel ore powder.

(2) Mixing the laterite nickel ore powder, water, an acid, and a reducing agent to obtain an ore pulp, and then subjecting the ore pulp to atmospheric pressure acid leaching at a temperature of 50-90° C. for 1-5 h to obtain a leaching residue and a leaching solution; wherein the concentration of the acid is 1-3 mol/L; the dosage of the reducing agent is 5-20 g/L; and the solid-liquid ratio of the ore pulp is 50-300 g/L.

The acid used in the atmospheric pressure acid leaching of the disclosure is an organic acid or an inorganic acid commonly used in the art. For example, the inorganic acid can be one or more of sulfuric acid, phosphoric acid, nitric acid, and hydrochloric acid. The organic acid can be one or more of formic acid, oxalic acid, citric acid, acetic acid, and ascorbic acid. The reducing agent may be a reducing agent commonly used in the art, such as one or more of sodium sulfite, sodium bisulfite, sodium metabisulfite, iron powder, and ferrous sulfate.

(3) Adding any one or more of soluble fluoride salts such as sodium fluoride, potassium fluoride, and ammonium fluoride and soluble sodium salts such as sodium chloride, sodium fluoride, and sodium sulfate to the leaching solution, wherein the dosage of the soluble fluoride salts is 3-20 g/L and the amount of the soluble sodium salts is 5-20 g/L; controlling the pH of the leaching solution to be 1-3 by using a dilute alkaline solution, and reacting at room temperature for 0.5-3 h so that aluminum precipitates in the form of cryolite, and silicon precipitates in the form of sodium fluorosilicate; and performing solid-liquid separation to obtain a silicon-aluminum residue and a de-silicon-aluminumed liquid.

(4) Adding a phosphorus source to the de-silicon-aluminumed liquid for a precipitation reaction, wherein the phosphorus source can be one or more of phosphoric acid, sodium phosphate, ammonium dihydrogen phosphate, ammonium monohydrogen phosphate, and ammonium phosphate, preferably sodium phosphate, and the molar ratio of the phosphorus source to the iron element in the leaching solution is (1-1.1): 1; de-silicon-aluminumed liquid to obtain iron phosphate and de-ironed liquid.

The method for preparing iron phosphate by precipitation according to the disclosure is preferably a "two-step method" process, i.e. firstly precipitating to prepare crude iron phosphate and then performing a transition ageing to prepare battery-grade iron phosphate. The whole process parameters are controlled as follows: controlling the pH of the de-silicon-aluminumed liquid to 1.8-2.0 using dilute sulfuric acid or dilute alkaline solution, reacting the phosphorus source with the iron in the solution at a temperature of 55-60° C. for 2 h, then adding a phosphorus source to the solution, the dosage thereof being 0.1 mol/L, controlling the temperature to 85-90° C., continuing the reaction for 2 h, filtering, and washing to obtain battery-grade iron phosphate.

(5) Subjecting the de-ironed liquid to a first step of cyclone electrolysis to obtain a zinc-chromium alloy and a first cyclone electrolyzed liquid; wherein the conditions for the first step of cyclone electrolysis include: the solution acidity is 0.1-0.3 mol/L; the temperature is 30-40° C.; the current density is 400-600 A/m$^2$; the electrolysis time is 5-10 h; the cathode is a crude zinc plate; the anode is a lead-silver alloy plate; a zinc-chromium alloy is deposited on the cathode plate in the electrolysis process; and the substitution period of the cathode plate is 48 h.

The disclosure also allows for further electrolytic refining of the zinc-chromium alloy deposited on the cathode plate to obtain high-purity zinc after the first step of cyclone electrolysis using means available in the industry.

(6) Subjecting the first step of cyclone electrolyzed liquid to a second step of cyclone electrolysis to obtain a nickel-cobalt alloy, a manganese oxide, and a second cyclone electrolyzed liquid; wherein the conditions for the second step of cyclone electrolysis include: the pH of the first cyclone electrolyzed liquid is controlled to 2-4; the temperature is 40-50° C.; the current density is 100-200 A/m$^2$; and the electrolysis time is 5-10 h; the cathode is a stainless steel plate; the anode is a lead-silver alloy plate and provided with a membrane bag; the stripping period of the Ni—Co alloy formed by the cathode electrodeposition is 48 h to obtain the Ni—Co alloy; and $MnO_2$ is collected in the anode membrane bag.

(7) Adding sodium carbonate to the second cyclone electrolyzed liquid to adjust the pH of the solution to 10-12, precipitating and reacting at room temperature for 0.5 h, and performing solid-liquid separation to obtain magnesium carbonate and a magnesium precipitation liquid.

(8) Evaporating and concentrating the de-magnesiumed liquid, crystallizing out to obtain sodium sulfate, and using the sodium sulfate as a sodium salt for silicon-aluminum removal in step (3).

In order to make the objectives, technical solutions, and advantages of the disclosure clearer, embodiments of the disclosure will be described in further detail below.

The composition of the saprolite laterite nickel ore used in the following examples is shown in Table 1:

TABLE 1

Composition of saprolite laterite nickel ore

| Element | Ni | Co | Mn | Fe | Al | Cr | Ca | Mg | Si |
|---|---|---|---|---|---|---|---|---|---|
| Content | 1.24% | 0.1% | 0.75% | 43.82% | 3.36% | 0.97% | 0.01% | 0.89% | 12-14% |

Example 1

A method for extracting metals from saprolite laterite nickel ore included the following steps.

The saprolite laterite nickel ore was separated and ground to obtain a laterite nickel ore powder. Then, the laterite nickel ore powder, water, sulfuric acid, and sodium metabisulfite were mixed according to a solid-liquid ratio of 200 g/L to prepare an ore pulp. The sulfuric acid concentration in the ore pulp was 2 mol/L and the sodium metabisulfite was 10 g/L. The ore pulp was heated to 80° C. and stirred for leaching for 2 h. A leaching residue and a leaching solution were obtained by filtration after the reaction was finished. The contents of Ni, Co, Mn, Fe, and other metals in the leaching residue were less than 0.05%. The residual acid in the leaching solution was about 0.3 mol/L. The leaching residue can be used as brick-making material or directly landfilled.

Figure 2:
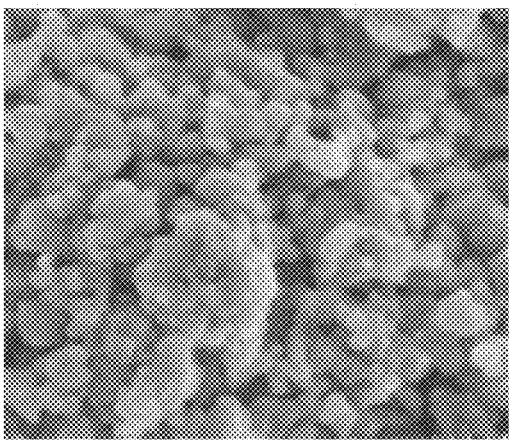
FIG. 2 is the SEM image of iron phosphate prepared in Example 1 of the disclosure.

The leaching solution was added with 10 g/L of NaF and 10 g/L of $Na_2SO_4$. The pH was adjusted to 2 by using a 10% NaOH solution. The reaction was carried out for 1 h and then filtered to obtain a silicon-aluminum residue and a de-silicon-aluminumed liquid. The concentrations of residual aluminum and silicon in the de-silicon-aluminumed liquid were measured to be reduced to less than 5 ppm. The de-silicon-aluminumed liquid was continued to be added with sodium phosphate. The molar ratio P/Fe in the solution was adjusted to be 1.05. Iron was precipitated using a "two-step method" process and filtered to obtain iron phosphate and a de-ironed liquid. The Fe/P molar ratio in iron phosphate was determined to be 0.975, and the content of impurity elements met the requirements of Chinese battery-grade iron phosphate industry standard (HG/T 4701-2021). The SEM diagram of iron phosphate is shown in FIG. 2.

The de-ironed liquid was subjected to a first and second steps of cyclone electrolysis to recover valuable metals. The process parameters of the first step of cyclone electrolysis included: the acidity of the de-ironed liquid was controlled to be 0.2 mol/L; the solution temperature was 35° C.; the current density was 500 A/m$^2$; and the electrolysis time was 8 h. The cathode was a crude zinc plate and the anode was a lead-silver alloy plate. A zinc-chromium alloy was deposited on the cathode plate in the electrolysis process. The substitution period of the cathode plate was 48 h. After completion of electrolysis, the concentration of $Zn^{2+}$ decreased to less than 10 ppm, the concentration of $Cr^{3+}$ decreased to less than 5 ppm, and the loss rates of $Ni^{2+}$, $Co^{2+}$, $Mn^{2+}$ were less than 1%. Then, the first step of cyclone electrolyzed liquid was subjected to a second step of cyclone electrolysis to obtain a nickel-cobalt alloy, a manganese oxide, and a second cyclone electrolyzed liquid. The process parameters of the second step of cyclone electrolysis included: the pH of the solution was adjusted to 3; the solution temperature was 50° C.; the current density was 150 A/m$^2$; and the electrolysis time was 8 h. The cathode was a stainless steel plate; the anode was a lead-silver alloy plate and provided with a membrane bag; the stripping period of the Ni—Co alloy formed by the cathode electrodeposition was 48 h to obtain the Ni—Co alloy; and $MnO_2$ was collected in the anode membrane bag. After the electrolysis was completed, the concentration of $Ni^{2+}$ and $Co^{2+}$ ions in the solution decreased to below 50 ppm, and the concentration of $Mn^{2+}$ ions decreased to below 10 ppm.

The second cyclone electrolyzed liquid was added with a saturated sodium carbonate solution to adjust the pH of the solution to 11. The reaction was carried out 1 h and then filtered to obtain $MgCO_3$. The concentration of $Mg^{2+}$ in the solution decreased to less than 20 ppm. The de-magnesiumed liquid was evaporated and concentrated to obtain sodium sulfate by using the existing technical means in the industry, and the sodium sulfate was reused in the silicon-aluminum removal stage.

Example 2

A method for extracting metals from saprolite laterite nickel ore includes the following steps:

The saprolite laterite nickel ore was separated and ground to obtain a laterite nickel ore powder. Then, the laterite nickel ore powder, water, sulfuric acid, and sodium metabisulfite were mixed according to a solid-liquid ratio of 200 g/L to prepare an ore pulp. The sulfuric acid concentration in the ore pulp was 2 mol/L and the sodium metabisulfite was 10 g/L. The ore pulp was heated to 80° C. and stirred for leaching for 2 h. A leaching residue and a leaching solution were obtained by filtration after the reaction was finished. The contents of Ni, Co, Mn, Fe, and other metals in the leaching residue were less than 0.05%. The residual acid in the leaching solution was about 0.3 mol/L. The leaching residue can be used as a brick-making material or directly landfilled.

The leaching solution was added with 10 g/L of NaF and 10 g/L of $Na_2SO_4$. The pH was adjusted to 2 by using a 10% NaOH solution. The reaction was carried out for 1 h and then filtered to obtain a silicon-aluminum residue and a de-silicon-aluminumed liquid. The concentrations of residual aluminum and silicon in the de-silicon-aluminumed liquid were measured to be reduced to less than 5 ppm. The de-silicon-aluminumed liquid was continued to be added with sodium phosphate. The molar ratio P/Fe in the solution was adjusted to be 1.05. Iron was precipitated using a "two-step method" process and filtered to obtain iron phosphate and a de-ironed liquid. The Fe/P molar ratio in iron phosphate was determined to be 0.975, and the content of impurity elements met the requirements of Chinese battery-grade iron phosphate industry standard (HG/T 4701-2021).

The de-ironed liquid was subjected to a first and second steps of cyclone electrolysis to recover valuable metals. The process parameters of the first step of cyclone electrolysis included: the acidity of the de-ironed liquid was controlled to be 0.3 mol/L; the solution temperature was 35° C.; the current density was 600 $A/m^2$; and the electrolysis time was 5 h. The cathode was a crude zinc plate and the anode was a lead-silver alloy plate. A zinc-chromium alloy was deposited on the cathode plate in the electrolysis process. The substitution period of the cathode plate was 48 h. After completion of electrolysis, the concentration of $Zn^{2+}$ decreased to less than 10 ppm, the concentration of $Cr^{3+}$ decreased to less than 5 ppm, and the loss rates of $Ni^{2+}$, $Co^{2+}$, $Mn^{2+}$ were less than 1%. Then the one-step cyclone electrolyzed liquid was subjected to a second step of cyclone electrolysis to obtain a nickel-cobalt alloy, a manganese oxide, and a second cyclone electrolyzed liquid. The process parameters of the second step of cyclone electrolysis included: the pH of the solution was adjusted to 2; the solution temperature was 50° C.; the current density was 100 $A/m^2$; and the electrolysis time was 8 h. The cathode was a stainless steel plate; the anode was a lead-silver alloy plate and provided with a membrane bag; the stripping period of the Ni—Co alloy formed by the cathode electrodeposition was 48 h to obtain the Ni—Co alloy; and $MnO_2$ was collected in the anode membrane bag. After the electrolysis was completed, the concentration of $Ni^{2+}$ and $Co^{2+}$ ions in the solution decreased to below 50 ppm, and the concentration of $Mn^{2+}$ ions decreased to below 10 ppm.

The second cyclone electrolyzed liquid was added with a saturated sodium carbonate solution to adjust the pH of the solution to 11. The reaction was carried out 1 h and then filtered to obtain $MgCO_3$. The concentration of $Mg^{2+}$ in the solution decreased to less than 20 ppm. The de-magnesiumed liquid was evaporated and concentrated to obtain sodium sulfate by using the existing technical means in the industry, and the sodium sulfate was reused in the aluminum-silicon removal stage.

Example 3

A method for extracting metals from saprolite laterite nickel ore includes the following steps:

The saprolite laterite nickel ore was separated and ground to obtain a laterite nickel ore powder. Then, the laterite nickel ore powder, water, sulfuric acid, and sodium metabisulfite were mixed according to a solid-liquid ratio of 300 g/L to prepare an ore pulp. The sulfuric acid concentration in the ore pulp was 3 mol/L and the sodium metabisulfite was 5 g/L. The ore pulp was heated to 50° C. and stirred for leaching for 5 h. A leaching residue and a leaching solution were obtained by filtration after the reaction was finished. The contents of Ni, Co, Mn, Fe, and other metals in the leaching residue were less than 0.05%. The residual acid in the leaching solution was about 0.3 mol/L. The leaching residue can be used as a brick-making material or directly landfilled.

The leaching solution was added with 20 g/L of NaF and 10 g/L of $Na_2SO_4$. The pH was adjusted to 2 by using a 10% NaOH solution. The reaction was carried out for 1 h and then filtered to obtain a silicon-aluminum residue and a de-silicon-aluminumed liquid. The concentrations of residual aluminum and silicon in the de-silicon-aluminumed liquid were measured to be reduced to less than 5 ppm. The de-silicon-aluminumed liquid was continued to be added with sodium phosphate. The molar ratio P/Fe in the solution was adjusted to be 1.05. Iron was precipitated using a "two-step method" process and filtered to obtain iron phosphate and a de-ironed liquid. The Fe/P molar ratio in iron phosphate was determined to be 0.975, and the content of impurity elements met the requirements of Chinese battery-grade iron phosphate industry standard (HG/T 4701-2021).

The de-ironed liquid was subjected to a first and second steps of cyclone electrolysis to recover valuable metals. The process parameters of the first step of cyclone electrolysis included: the acidity of the de-ironed liquid was controlled to be 0.1 mol/L; the solution temperature was 35° C.; the current density was 400 $A/m^2$; and the electrolysis time was 10 h. The cathode was a crude zinc plate and the anode was a lead-silver alloy plate. A zinc-chromium alloy was deposited on the cathode plate in the electrolysis process. The substitution period of the cathode plate was 48 h. After completion of electrolysis, the concentration of $Zn^{2+}$ decreased to less than 10 ppm, the concentration of $Cr^{3+}$ decreased to less than 5 ppm, and the loss rates of $Ni^{2+}$, $Co^{2+}$, $Mn^{2+}$ were less than 1%. Then the one-step cyclone electrolyzed liquid was subjected to a second step of cyclone electrolysis to obtain a nickel-cobalt alloy, a manganese oxide, and a second cyclone electrolyzed liquid. The process parameters of the second step of cyclone electrolysis included: the pH of the solution was adjusted to 4; the solution temperature was 50° C.; the current density was 200 $A/m^2$; and the electrolysis time was 10 h. The cathode was a stainless steel plate; the anode was a lead-silver alloy plate and provided with a membrane bag; the stripping period of the Ni—Co alloy formed by the cathode electrodeposition was 48 h to obtain the Ni—Co alloy; and $MnO_2$ was collected in the anode membrane bag. After the electrolysis was completed, the concentration of $Ni^{2+}$ and $Co^{2+}$ ions in the solution decreased to below 50 ppm, and the concentration of $Mn^{2+}$ ions decreased to below 10 ppm.

The second cyclone electrolyzed liquid was added with a saturated sodium carbonate solution to adjust the pH of the solution to 11. The reaction was carried out 1 h and then filtered to obtain $MgCO_3$. The concentration of $Mg^{2+}$ in the solution decreased to less than 20 ppm. The de-magnesiumed liquid was evaporated and concentrated to obtain sodium sulfate by using the existing technical means in the industry, and the sodium sulfate was reused in the aluminum-silicon removal stage.

The extraction rates of valuable metals from saprolite laterite nickel ore of Examples 1-3 are shown in Table 2 below, wherein the Zn—Cr extraction rate is the ratio of the mass of Zn—Cr alloy stripped from the one-step cyclone electrolytic cathode plate to the total mass of Zn and Cr in the laterite nickel ore; the Ni—Co extraction rate is the ratio of the total mass of Ni—Co alloy stripped from the two-step cyclone electrolytic cathode plate to the total mass of Ni and Co in the laterite nickel ore.

TABLE 2

Extraction rate of various valuable metals

| Item | Ni—Co extraction rate | Zn—Cr extraction rate | Mn extraction rate |
|---|---|---|---|
| Example 1 | 96.5% | 98.9% | 92.1% |
| Example 2 | 95.8% | 98.6% | 91.8% |
| Example 3 | 95.3% | 98.2% | 90.9% |

As can be seen from the table above, by means of the process steps provided by the disclosure, an effective Ni—Co extraction rate exceeding 95%, an effective Mn extraction rate exceeding 90%, and an effective Zn—Cr extraction rate exceeding 98% can be achieved throughout the entire process.

In summary, according to the disclosure: (1) atmospheric pressure leaching avoids the large amount of energy consumption caused by high pressure leaching in the existing process, and promotes carbon dioxide emission reduction.

(2) In the treatment process, the resource utilization of iron element to prepare battery-grade iron phosphate and magnesium element to prepare magnesium carbonate are achieved simultaneously, without additional smelting slag recycling treatment process, which greatly reduces the complexity of the process flow and has more economic cost advantages.

(3) The cyclone electrolysis technology is introduced into the field of laterite nickel ore smelting. The first and second steps of cyclone electrolysis can solve the difficult separation problem of zinc-chromium and nickel-cobalt-manganese in the traditional smelting process. High-purity Zn—Cr alloy and Ni—Co alloy can be obtained respectively. Manganese can be simultaneously extracted and utilized in the form of $MnO_2$.

It should be noted that each of the above-mentioned examples belongs to the same inventive concept, and the description of each example has its own emphasis. Where the description of each example is not exhaustive, reference can be made to the description of other examples.

The foregoing examples merely present embodiments of the disclosure and are described in more detail and are not to be construed as limiting the scope of the disclosure. It should be noted that, for a person of ordinary skill in the art, a number of deformations and improvements can be made without departing from the conception of the disclosure, all of which fall within the scope of the disclosure. Therefore, the scope of the patent for the disclosure shall be governed by the appended claims.

What is claimed is:

1. A method for extracting metals from saprolite laterite nickel ore, characterized by comprising the following steps:

(1) separating and grinding the saprolite laterite nickel ore to obtain a laterite nickel ore powder;

(2) mixing the laterite nickel ore powder, water, an acid, and a reducing agent to obtain an ore pulp, and subjecting the ore pulp to atmospheric pressure acid leaching to obtain a leaching residue and a leaching solution;

(3) adding a soluble fluoride salt and soluble sodium salt to the leaching solution and performing solid-liquid separation to obtain a silicon-aluminum residue and a de-silicon-aluminumed liquid; wherein the silicon-aluminum residue contains sodium fluoroaluminate and sodium fluorosilicate;

(4) adding a phosphorus source to the de-silicon-aluminumed liquid, and performing solid-liquid separation to obtain an iron phosphate and a de-ironed liquid;

(5) subjecting the de-ironed liquid to a first step of cyclone electrolysis to obtain a zinc-chromium alloy and a first cyclone electrolyzed liquid;

(6) subjecting the first cyclone electrolyzed liquid to a second step of cyclone electrolysis to obtain a nickel-cobalt alloy, a manganese oxide, and a second cyclone electrolyzed liquid; and (7) adding sodium carbonate to the second cyclone electrolyzed liquid for a precipitation reaction to obtain magnesium carbonate and a de-magnesiumed liquid.

2. The method for extracting metals from saprolite laterite nickel ore according to claim 1, characterized in that the acid in step (2) is an organic acid or an inorganic acid, and the reducing agent is one or more of sodium sulfite, sodium bisulfite, sodium metabisulfite, iron powder, and ferrous sulfate.

3. The method for extracting metals from saprolite laterite nickel ore according to claim 1, characterized in that in step (2), the concentration of the acid is 1-3 mol/L; the dosage of the reducing agent is 5-20 g/L; and the solid-liquid ratio of the ore pulp is 50-300 g/L.

4. The method for extracting metals from saprolite laterite nickel ore according to claim 1, characterized in that the leaching temperature of the atmospheric pressure acid leaching in step (2) is 50-90° C. and the leaching time is 1-5 h.

5. The method for extracting metals from saprolite laterite nickel ore according to claim 1, characterized in that the soluble fluoride salt in step (3) is at least one of sodium fluoride, potassium fluoride, and ammonium fluoride; and the soluble sodium salt is at least one of sodium fluoride, sodium chloride, and sodium sulfate.

6. The method for extracting metals from saprolite laterite nickel ore according to claim 1, characterized in that in step (3), a dosage of the soluble fluoride salt used is 3-20 g/L, and a dosage of the soluble sodium salt is 5-20 g/L; and a pH of the leaching solution is controlled to be 1-3 by using a dilute alkaline solution, and the reaction is carried out at room temperature for 0.5-3 h.

7. The method for extracting metals from saprolite laterite nickel ore according to claim 1, characterized in that the phosphorus source in step (4) is one or more of phosphoric acid, sodium phosphate, ammonium dihydrogen phosphate, ammonium monohydrogen phosphate, and ammonium phosphate; and the molar ratio of the phosphorus source to the elemental iron in the leaching solution is (1-1.1):1.

8. The method for extracting metals from saprolite laterite nickel ore according to claim 1, characterized in that in the first step of cyclone electrolysis of step (5), the acidity of the de-ironed liquid is 0.1-0.3 mol/L; the temperature is 30-40° C.; the current density is 400-600 A/m2; and the electrolysis time is 5-10 h.

9. The method for extracting metals from saprolite laterite nickel ore according to claim 1, characterized in that in the second step of cyclone electrolysis of step (6), the pH of the first cyclone electrolyzed liquid is controlled to 2-4; the temperature is 40-50° C.; the current density is 100-200 A/m2; and the electrolysis time is 5-10 h.

10. The method for extracting metals from saprolite laterite nickel ore according to claim 1, characterized by further comprising subjecting the de-magnesiumed liquid to evaporation and concentration to obtain sodium sulfate, and the sodium sulfate is reused as a sodium salt for silicon-aluminum removal in step (3).

* * * * *